US007183945B2

(12) United States Patent
DiDomenico et al.

(10) Patent No.: US 7,183,945 B2
(45) Date of Patent: Feb. 27, 2007

(54) METHOD AND SYSTEM FOR VIDEO CAPTURE OF VEHICLE INFORMATION

(75) Inventors: John DiDomenico, Tuscon, AZ (US); Paul F. Kyle, Tuscon, AZ (US)

(73) Assignee: SPX Corporation, Charlotte, NC (US)

( * ) Notice: Subject to any disclaimer, the term of this patent is extended or adjusted under 35 U.S.C. 154(b) by 920 days.

(21) Appl. No.: 09/932,499

(22) Filed: Aug. 17, 2001

(65) Prior Publication Data

US 2004/0218052 A1 Nov. 4, 2004

(51) Int. Cl.
*G08G 1/017* (2006.01)

(52) U.S. Cl. ..... 340/937; 340/933

(58) Field of Classification Search ..... 340/933, 340/935, 936, 937, 938; 702/142, 143, 149; 710/300, 305; 348/143, 148, 149; 250/338.5
See application file for complete search history.

(56) References Cited

U.S. PATENT DOCUMENTS

| | | | | |
|---|---|---|---|---|
| 3,696,247 | A | 10/1972 | McIntosh et al. | 250/83.3 H |
| 3,811,776 | A | 5/1974 | Blau, Jr. | 356/51 |
| 3,957,372 | A | 5/1976 | Jowett et al. | 356/51 |
| 3,958,122 | A | 5/1976 | Jowett et al. | 250/346 |
| 3,973,848 | A | 8/1976 | Jowett et al. | 356/51 |
| 4,012,144 | A | 3/1977 | Hedelman | 356/73 |
| 4,013,260 | A | 3/1977 | McClatchie et al. | 250/343 |
| 4,160,373 | A | 7/1979 | Fastaia et al. | 73/23 |
| 4,171,909 | A | 10/1979 | Kramer et al. | 356/73 |
| 4,204,768 | A | 5/1980 | N'Guyen | 356/243 |
| 4,310,249 | A | 1/1982 | Kramer | 356/414 |
| 4,348,732 | A | 9/1982 | Kreft | 364/571 |
| 4,372,155 | A | 2/1983 | Butler et al. | 73/114 |
| 4,390,785 | A | 6/1983 | Faulhaber et al. | 250/330 |
| 4,432,316 | A | 2/1984 | Ogita | 123/328 |
| 4,490,845 | A | 12/1984 | Steinbruegge et al. | 382/1 |
| 4,560,873 | A | 12/1985 | McGowan et al. | 250/339 |
| 4,602,160 | A | 7/1986 | Mactaggart | 250/341 |
| 4,632,563 | A | 12/1986 | Lord, III | 356/437 |
| 4,638,345 | A | 1/1987 | Elabd et al. | 357/24 |
| 4,663,522 | A | 5/1987 | Welbourn et al. | 250/223 R |
| 4,678,914 | A | 7/1987 | Melrose et al. | 250/343 |

(Continued)

OTHER PUBLICATIONS

Radian Corp.; "Developing an Inspection/Maintenance Program for Alternatively-Fueled Vehicles"; 1993.

(Continued)

*Primary Examiner*—Van T. Trieu
(74) *Attorney, Agent, or Firm*—Baker & Hostetler LLP

(57) ABSTRACT

A system for collecting and managing information relating to vehicles includes a digital image collection system positioned to capture an image of a vehicle travelling along a roadway. The captured images are delivered to a computer program memory via a communications link at a transfer rate substantially equal to 100, 200, and/or 400 megabits per second. A second device collects additional information relating to the vehicle, such as the vehicle's speed, acceleration, and/or emissions data, and also delivers such information to the memory. Alternatively, two or more video capture devices may be connected in series via communications links that are all capable of transmitting data at rates substantially equal to 100, 200, and/or 400 megabits per second, such that the images collected by all of the capture devices are delivered to the memory.

19 Claims, 4 Drawing Sheets

U.S. PATENT DOCUMENTS

| | | | | |
|---|---|---|---|---|
| 4,687,934 | A | 8/1987 | Passaro et al. | 250/343 |
| 4,710,630 | A | 12/1987 | Kuppenheimer, Jr. et al. | 250/353 |
| 4,746,218 | A | 5/1988 | Lord, III | 356/437 |
| 4,795,253 | A | 1/1989 | Sandridge et al. | 356/51 |
| 4,818,705 | A | 4/1989 | Schneider et al. | 436/164 |
| 4,829,183 | A | 5/1989 | McClatchie et al. | 250/346 |
| 4,868,622 | A | 9/1989 | Shigenaka | 357/30 |
| 4,875,084 | A | 10/1989 | Tohyama | 357/30 |
| 4,914,719 | A | 4/1990 | Conlon et al. | 250/339 |
| 4,924,095 | A | 5/1990 | Swanson, Jr. | 250/338.5 |
| 4,963,023 | A | 10/1990 | Goldovsky et al. | 356/308 |
| 4,999,498 | A | 3/1991 | Hunt et al. | 250/338.5 |
| 5,002,391 | A | 3/1991 | Wolfrum et al. | 356/307 |
| 5,041,723 | A | 8/1991 | Ishida et al. | 250/339 |
| 5,061,854 | A | 10/1991 | Kroutil et al. | 250/339 |
| 5,076,699 | A | 12/1991 | Ryan et al. | 356/437 |
| 5,157,288 | A | 10/1992 | Hill | 307/511 |
| 5,185,648 | A | 2/1993 | Baker et al. | 257/189 |
| 5,210,702 | A | 5/1993 | Bishop et al. | 364/496 |
| 5,239,860 | A | 8/1993 | Harris et al. | 73/61.48 |
| 5,252,828 | A | 10/1993 | Kert et al. | 250/339 |
| 5,255,511 | A | 10/1993 | Maus et al. | 60/274 |
| 5,307,626 | A | 5/1994 | Maus et al. | 60/274 |
| 5,319,199 | A | 6/1994 | Stedman et al. | 250/338.5 |
| 5,332,901 | A | 7/1994 | Eckles et al. | 250/345 |
| 5,343,043 | A | 8/1994 | Johnson | 250/338.5 |
| 5,361,171 | A | 11/1994 | Bleier | 359/855 |
| 5,371,367 | A | 12/1994 | DiDomenico et al. | 250/338.5 |
| 5,373,160 | A | 12/1994 | Taylor | 250/338.5 |
| 5,401,967 | A | 3/1995 | Stedman et al. | 250/338.5 |
| 5,418,366 | A | 5/1995 | Rubin et al. | 250/338.5 |
| 5,489,777 | A | 2/1996 | Stedman et al. | 250/338.5 |
| 5,498,872 | A | 3/1996 | Stedman et al. | 250/338.5 |
| 5,545,897 | A | 8/1996 | Jack | 250/339.13 |
| 5,583,765 | A | 12/1996 | Kleehammer | 364/423.098 |
| 5,591,975 | A | 1/1997 | Jack et al. | 250/338.5 |
| 5,621,166 | A | 4/1997 | Butler | 73/116 |
| 5,644,133 | A | 7/1997 | Didomenico et al. | 250/338.5 |
| 5,719,396 | A | 2/1998 | Jack et al. | 250/338.5 |
| 5,726,450 | A | 3/1998 | Peterson et al. | 250/338.5 |
| 5,797,682 | A | 8/1998 | Kert et al. | 374/123 |
| 5,812,249 | A | 9/1998 | Johnson et al. | 356/28 |
| 5,831,267 | A | 11/1998 | Jack et al. | 250/338.5 |
| 5,922,948 | A | 7/1999 | Lesko et al. | 73/117.3 |
| 6,057,923 | A | 5/2000 | Sachse | 356/364 |
| 6,140,941 | A * | 10/2000 | Dwyer et al. | 340/928 |
| 6,230,087 | B1 | 5/2001 | Didomenico et al. | 701/29 |
| 6,307,201 | B1 | 10/2001 | Didomenico et al. | 250/339.13 |
| 6,455,851 | B1 * | 9/2002 | Lord et al. | 250/338.5 |
| 6,681,195 | B1 * | 1/2004 | Poland et al. | 702/142 |
| 6,892,262 | B1 * | 5/2005 | Taki | 710/300 |
| 6,929,823 | B2 * | 8/2005 | Holfter | 427/190 |

OTHER PUBLICATIONS

Islam, Muhammed, Rendahl, Craig S., Cors, Rebecca; "Wisconsin's Remove Vehicle Emissions Sensing Study"; Final Report 1995.

Walsh, P.A., Gertler, A.W.; "Texas 1996 Remote Sensing Feasibility Study"; Final Report 1997.

Popp, Peter J.; "Development of a High-Speed Ultraviolet Spectrophotometer Capable of Real-Time NO and Aromatic Hydrocarbon Detection in Vehicle Exhaust"; pp. 4-3 & 4-12;Coordinating Research Council 1997.

McVey, Iain Frederick; "Development of a Remote Sensor for Mobile Source Nitric Oxide"; University of Denver 1992.

Beaton, S.P., Bishop, G.A. and Stedman D.H.; Emissions Characteristics of Mexico City Vehicles; pp. 42, 1424-1429; Journal of Air and Waste Management Assoc. 1992.

Zhang, Yi, Stedman, Donald H., Bishop, Gary A., Beaton, Stuart P., Guenther, Paul L. and McVey, Iain F.; "Enhancement of Remote Sensing for Mobile Source Nitric Oxide"; Journal of Air & Waste Management 1996; vol. 46, pp. 25-29.

Popp, Peter John; "Remote Sensing of Nitric Oxide Emissions from Planes, Trains and Automobiles"; University of Denver 1999.

Zhang, Yi, Stedman, Donald H., Bishop, Gary A., Beaton, Stuart P., and Guenther, Paul L.; "Worldwide On-Road Vehicle Exhaust Emissions Study by Remote Sensing"; Environmental Science & Technology 1995; vol. 29#9. pp. 2286-2294.

Glover, Edward L., Mickelsen, Jan and McClement Dennis; Evaluation of Methods to Determine Catalyst Efficiency in the Inspection/Maintenance Process; Society of Automotive Engineers; SAE#9600092.

Butler, James, Gierczak, Christine and Liscombe Paula; "Factors Affecting the NDIR Measurement of Exhaust Hydrocarbons"; Coordinating Research Council 1995; pp. 4-171 & 4-190.

MacKay, Gervase I., Nadler, S. Don, Karecki, David R., Schiff, Harold I., Butler, James W., Gierczak, Christine A. and Jesion, Gerald; "Final Phase 1b Report to the CRC and NREL for Research Performed Under Agreement No. VE-8-2"; Coordinating Research Council 1994.

Peterson, James E. and Stedman, Donald H.; "Find and Fix the Polluters"; Chemtech 1992; pp. 47-53.

Bishop, Gary A. and Stedman Donald H.; "Infrared Emissions and Remote Sensing"; Journal of Air and Waste Management Assoc. 1992; vol. 42#5, pp. 695-697.

Bishop, Gary A., Starkey, John R., Ihlenfeldt, Anne, Williams, Walter J. and Stedman Donald H.; "IR Long-Path Photometry: A Remote Sensing Tool for Automobile Emissions"; Analytical Chemistry 1989; vol. 61#10, pp. 671A-677A.

Axelsson, Hakan, Eilard, Anders, Emanuelsson, Annika, Galle, Bo, Edner, Hans, Regnarson Par and Kloo Henrik; "Measurement of Aromatic Hydrocarbons with the DOAS Technique"; Applied Spectroscopy 1995; vol. 49#9, pp. 1254-1260.

Baum, Marc M., Kiyomiya, Eileen S., Kumar Sasi and Lappas, Anastasios M.' "Multicomponent Remote Sensing of Vehicle Exhaust by Dispersive Absorption Spectroscopy. 1. Effect of Fuel Type and Catalyst Performance"; Environmental Science and Technology 2000; pp. 34 & 2851-2858.

Stedman, Donald H. and Smith, Dennis L.; "$NO_x$ Data by Remote Sensing"; Coordinating Research Council 1995; pp. 4-47 & 4-63.

Shore, P.R. and Devries, R.S.; "On-line Hydrocarbon Speciation Using FTIR and CI-MS"; Society of Automotive Engineers 1992; SAE #922246.

Bishop, Gary A. and Stedman, Donald H.; "On-Road Carbon Monoxide Emission Measurement Comparisons for the 1988-1989 Colorado Oxy-Fuels Program"; Environmental Science & Technology 1990; pp. 24 & 843-847.

Stedman, Donald H., Bishop, Gary, Peterson, James E., and Geunther, Paul L.; "On-Road CO Remote Sensing in the Los Angeles Basin"; CA-EPA (CARB) 1991; pp. 24 & 843-847.

X-Rite Incorporated; "A Guide to Integrating Sphere Theory and Applications"; 2002; www.labsphere.com.

Geunther, Paul L., Stedman, Donald H., Bishop, Gary A., Beaton, Stuaret P., Bean, James H. and Quine Richard W.; "A Hydrocarbon Detector for the Remote Sensing of Vehicle Exhaust Emissions"; Review of Scientific Instruments 1994; vol. 66(4), pp. 3024-3029.

Stephens, Robert D., Mulawa, Patricia A., Giles, Michael T., Kennedy, Kenneth G., Groblicki, Peter J. and Cadle, Steven H.; "An Experimental Evaluation of Remote Sensing-Based Hydrocarbon Measurements: A Comparison to FID Measurements"; Journal of Air and Waste Management Assoc. 1996; pp. 46 & 148-158.

Stedman, Donald H.; "Automobile Carbon Monoxide Emissions"; Environmental Science and Technology 1989; vol. 23#2, pp. 147-149.

Adachi, Masayuki, Yamagishi, Yutaka, Inoue Kaori and Ishida, Kozo; "Automotive Emissions Analyses using FTIR Spectrophotometer"; Society of Automotive Engineers 1992; SAE #920723.

Koplow, Michael D., Jimenez, Jose L., Nelson, David D., Schmidt, Stephan E.; "Characterization of On-Road Vehicle NO Emissions by Means of a TILDAS Remote Sensing Instrument"; Coordinating Research Council 1997; pp. 8-35 & 8-62.

Guenther, Paul Leonard; "Contributions to On-Road Remoter Sensing of Automobile Exhaust"; University of Denver 1992.
Cox, Frank W., Walls, John R. and Carrel, Mark W.; "Determination of Catalyst Oxidation and Reduction Efficiencies from Tailpipe Emissions Measurements"; Society of Automotive Engineers 1997; SAE #972911.
Lawson, Douglas R., Groblicki, Peter J., Stedman, Donald H., Bishop, Gary A. and Guenther Paul L.; "Emissions from In-Use Motor Vehicles in Los Angeles: A Pilot Study of Remote Sensing and the Inspection and Maintenance Program"; Journal of Air and Waste Management Assoc. 1990; vol. 40#8, pp. 1096-1105.
Stedman, Donald H., Bishop, Gary A. and Pitchford, Marc L.; "Evaluation of a Remote Sensor for Mobile Source CO Emissions"; University of Denver 1991; Rpt.#EPA 600/4-90/032.
McLaren, Scott E., Stedman, Donald H., Greenlaw, Pamela D., Bath, Raymond J., and Spear, Richard D., "Comparison of an Open Path UV and FTIR Spectrometer"; Air and Waste Management Assoc.1992; vol. 92-73.10.
Bishop, Gary A., Zhang, Yi, McLaren, Scott E., Guenther, Paul L., Beaton, James E., Stedman, Donald H., Duncan, John W., McArver, Alexander Q., Pierson, William R., Groblicki, Peter J., Knapp, Kenneth T., Zweidinger, Roy B. and Day, Frank J.; Enhancements of Remote Sensing for Vehicle Emissions in Tunnels; Journal of Air and Waste Management 1994; vol. 44, pp. 169-175.
McLaren, Scott E. and Stedman Donald H.; "Flux Measurements Using Simultaneous Long Path Ultraviolet and Infrared Spectroscopy"; Air and Waste Management Assoc. 1990; vol. 90-86.6.
Bishop, Gary A., McLaren, Scott E., Stedman, Donald H., Pierson, William R., Zweidinger, Roy B. and Ray, William D; "Method Comparisons of Vehicle Emissions Measurements in the Fort McHenry and Tuscarora Mountain Tunnels"; Atmospheric Environment 1996; vol. 30#12, pp. 2307-2316.
McLaren, Scott; "Open Path Spectrometers for Atmospheric Monitoring"; University of Denver 1995.
Stedman, Donald H. and Bishop, Gary A.; "An Analysis of On-Road Remote Sensing as a Tool for Automobile Emissions Control"; Illinois Dept. of Energy & Natural Resources 1990; ILENR/RE-AQ-90/05.
Stedman, Donald H., Peterson, James E. and McVey, Iain F.; "On-Road Carbon Monoxide and Hydrocarbon Remote Sensing in the Chicago Area"; Illinois Dept. of Energy & Natural Resources 1991; ILENR/RE-AQ-91/14.
Lyons, Carol E. and Stedman, Donald H.; "Remote Sensing Enhanced Motor Vehicle Emissions Control for Pollution Reduction in the Chicago Metropolitan Area: Siting and Issue Analysis"; Illinois Dept. of Energy & Natural Resources 1991; ILENR/RE-AQ-91/15.
Durbin, Thomas D., Truex, Timothy J. and Norbeck, Joseph M.; "Particulate Measurements and Emissions Characterizations of Alternative Fuel Vehicle Exhaust"; National Renewable Energy Laboratory 1998; NREL/SR-540-25741; Subcont# ACI-7-16637-01.
Didomenico, John, Johnson, Jim, Webster, Jason and Rendahl, Craig S.; "Preliminary Results from Cold Start Sensor Testing"; Coordinating Research Council 1997; pp. 4-71 & 4-72.
Stephens, Robert D. and Cadle, Steven H.; "Remote Sensing Measurements of Carbon Monoxide Emissions from On-Road Vehicles"; Journal of Air and Waste Management Assoc. 1991; vol. 41#1, pp. 39-46.
Jimenez, Jose L., McRae, Gregory J., Nelson, David D., Zahniser, Mark S. and Kolb, Charles E.; "Remote Sensing of NO and $NO_2$ Emissions from Heavy-Duty Diesel Trucks Using Tunable Diode Lasers"; Environmental Science & Technology 2000; pp. 34 & 2380-2387.
Stedman, Donald H., Bishop, Gary A., Guenther, Paul L., Peterson, James E., Beaton, Stuart P. and McVey, Iain F.; "Remote Sensing of On-Road Vehicle Emissions"; University of Denver 1992; Contract #VE-8-1.
Singer, Brett C., Harley, Robert A., Littlejohn, David, Ho, Jerry and Vo, Thu; "Scaling of Infrared Remote Sensor Hydrocarbon Measurements for Motor Vehicle Emission Inventory Calculations"; Environmental Science and Technology 1998; vol. 32#21, pp. 3241-3428.
Atkinson, Chris M., McKain, David L., Gautam, Mridul, El-Gazzar, Laila, Lyons, Donald W. and Clark, Nigel N.; "Speciation of Heavy Duty Diesel Engine Exhaust Emissions"; Coordinating Research Council 1995; pp. 5-71 & 5-92.
Chaney, Lucian W.; "The Remote Measurment of Traffic Generated Carbon Monoxide"; Journal of Air Pollution Control Assoc. 1983; vol. 33#3, pp. 220-222.
Todd, Michael and Barth, Michael; "The Variation of Remote Sensing Emission Measurements with Respect to Vehicle Speed and Acceleration"; Coordinating Research Council 1995; pp. 4-1 & 4-14.
Hoshizaki, H., Wood, A.D and Kemp, D.D.; "Vehicle Inspection Instrumentation"; Lockheed Missiles & Space Company 1973; ARB-3C-235-7.
Sigsby, Jr., John E., Tejada, Silvestre and Ray, William; "Volatile Organic Compound Emissions from 46 In-Use Passenger Cars"; Environmental Science & Technology 1987; pp. 21 & 466-475.

* cited by examiner

METHOD AND SYSTEM FOR VIDEO CAPTURE OF VEHICLE INFORMATION

FIELD OF THE INVENTION

The present invention relates generally to video capture devices. More particularly, the present invention relates to a method and system for capturing, storing, and transmitting visual images of elements of vehicles for use in connection with emissions data collection, law enforcement, and/or transportation systems planning.

BACKGROUND OF THE INVENTION

The collection of visual images of vehicles as they move along a roadway has been found to be useful in an increasing number of applications. For example, the collection of visual images of vehicle license plates, along with images of vehicle types and/or colors, is useful in law enforcement to identify vehicles that exceed a speed limit and/or who otherwise violate traffic-related laws. When used in conjunction with other information, such as emissions data, vehicle inspection due dates, and other information, such images can be used to determine an individual vehicle's compliance with requirements such as emission requirements and inspection requirements. Such data can also be used for transportation systems planning. For example, the number of vehicles passing by a particular point over a time period may be collected, and such data may be compared to the visual images to determine the types of such vehicles, whether such vehicles exhibit in-state or out-of-state license plates, or other information. The prior art systems that provide for video capture of vehicle related information typically comprise analog video cameras placed along or near the side of a road. Such analog cameras feed collected visual images into a video capture card, which must be triggered, using software, to freeze the frame and commit the visual image into memory. The image is preferably digitized and compressed so that a larger number of images can be stored in a smaller amount of memory.

In some compression techniques, and especially techniques that start with analog images, the method of compression often results in degradation or loss of part of the original video image. In such a situation, if the license plate number and/or state is not legible in the stored image, the image cannot be used. In addition, many applications require more than just a license plate number, such as information relating to vehicle manufacturer, color, and/or type, which are all additional items of information which can be lost in the compression process.

In addition, the method of using an analog camera and capture board is expensive, as many pieces of equipment are required to accomplish the result. Further, many of the prior art video capture cards generally can handle only one camera. Accordingly, they are not desirable in applications where multiple cameras are required, such as in areas where multiple cameras are used to collect data across multiple lanes of a roadway.

Accordingly, it is desirable to provide an improved method and system for the capture of visual information relating to vehicles traveling on a roadway.

SUMMARY OF THE INVENTION

It is therefore a feature and advantage of the present invention to provide a novel video capture system as herein disclosed In accordance with one embodiment of the present invention, a system for managing visual images of vehicles includes a first digital video image collector positioned to capture a first data file that is representative of a visual image of at least one feature of a first vehicle moving on a roadway, The first digital video image collector includes: (1) a first communications port; (2) a computing device having a processor, a memory, and (3) a second communications port; a first communications link between the first communications port and the second communications port. A first information collection device is in communication with the computer and positioned to capture speed, acceleration, and/or emissions data corresponding to the first vehicle. Preferably, the first communications port an/or the first communications link is capable of transferring data at a transfer rate substantially equal to at least one of 100, 200, and 400 megabits per second and/or substantially complies with the Institute for Electrical and Electronics Engineers (IEEE) 1394 Standard for a High Performance Serial Bus, vehicle.

Optionally, the system also includes a second digital video image collector positioned to capture a second data file that is representative of a visual image of at least one feature of a second vehicle moving on a roadway. The second digital camera includes a third communications port and a second communications link between the third communications port and the first digital video image collector. Preferably, the second information collection device is further positioned to capture at least one of speed, acceleration, and emissions data corresponding to the second vehicle. Also preferably, this system includes a second information collection device positioned to capture at least one of speed, acceleration, and emissions data corresponding to the second vehicle. The third communications port and/or the third communications link should be capable of transferring data at a transfer rate substantially equal to at least one of 100, 200, and 400 megabits per second, and it should substantially comply with the IEEE 1394 Standard for a High Performance Serial Bus.

Optionally, the system also includes an illumination source positioned to provide illumination directed to the at least one feature of the first vehicle.

In accordance with an alternate embodiment, a method of capturing and managing vehicle images includes the steps of: (1) using a first video capture device to collect a first digital image of at least one feature of a first vehicle; (2) using a data collection device to collect first data representative of at least one of speed, acceleration, and emissions of the first vehicle; and (3) delivering the first digital image and the first data to a computer program memory via at least one communications link. Preferably, the delivering step is performed at a transfer rate substantially equal to at least one of 100, 200, and 400 megabits per second, and/or it is the delivering step is performed via a serial connection that substantially complies with the IEEE 1394 Standard for a High Performance Serial Bus.

There have thus been outlined the more important features of the invention in order that the detailed description thereof that follows may be better understood, and in order that the present contribution to the art may be better appreciated. There are, of course, additional features of the invention that will be described below and which will form at least part of the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting in any way.

As such, those skilled in the art will appreciate that the concept and objectives, upon which this disclosure is based, may be readily utilized as a basis for the design of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED

Embodiments of the Invention

Figure 1:
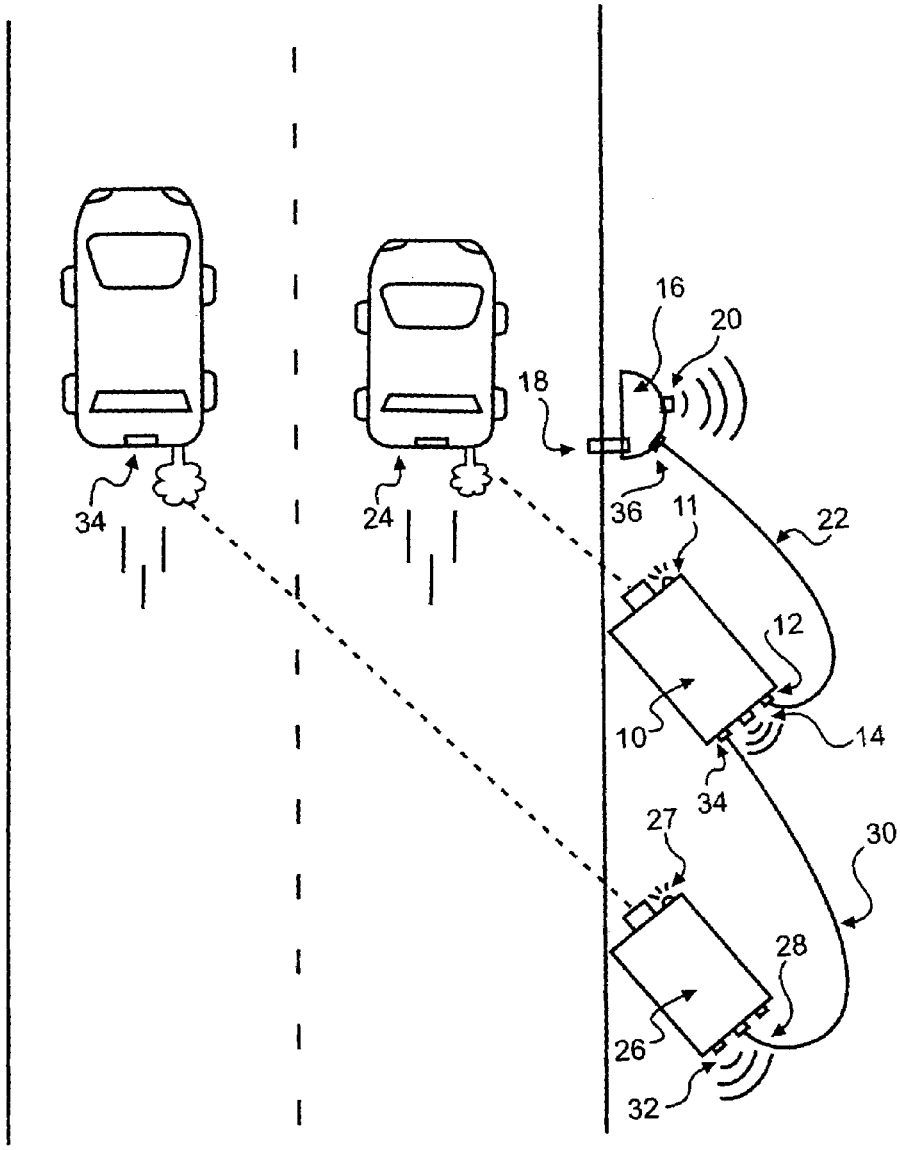
FIG. 1 illustrates an exemplary embodiment of the present inventive video capture system in connection with a system for capturing other information related to one or more vehicles.

A preferred embodiment of the present invention provides an improved method and system for capturing and managing video images corresponding to one or more features of a vehicle or vehicles in connection with other data relating to the vehicle or vehicles. A preferred embodiment of the present inventive system is illustrated in FIG. 1. Referring to FIG. 1, a first digital video capture device 10 is positioned along, near, or over a roadway and is positioned to capture a digital image of one or more features of a vehicle 24. Such features preferably include the vehicle's license plate number and state, and they may also include additional features, such as vehicle make, model, color, registration date, and/or inspection sticker data. Preferably, the position of the video capture device provides a skew angle to the vehicle features of not more than approximately 30 degrees. Other angles may be used, but they may not provide picture qualities that are as desirable as those within the range.

The video capture device 10 includes a first communications port 12 that delivers the digital image via a communications link 22 to a computing device 16 having a second communication port 36 that receives the digital image. The computing device 16 includes, at a minimum, a processor and memory, and the communications link 22 may be a cable, a wireless medium, a bus, or any other medium for communication. An information collection device 18 is in communication with computer 16. The information collection device 18 is also positioned along, near, or over or under a roadway to collect vehicle information such as emissions data, speed, and/or acceleration. Such data is also delivered to the computing device 16. In the exemplary illustration of FIG. 1, the information collection device 18 is an open path emission sensor that, in conjunction with a reflection unit 19, detects one or more components of the vehicle's exhaust.

Although the exemplary illustration in FIG. 1 shows the computing device 16 being housed in the same unit as the information collection device 18 and separate from the first video capture device 10, other embodiments are possible. For example, the computing device 16 may be housed within the video capture device 10, in which case the communications link 22 between the video capture device 10 and computing device 16 will be included within the video capture device 10. In addition, the information collection device 18 may also be housed within the same unit as the video capture device 10. In such an embodiment, the video capture device is preferably positioned to capture the image after the vehicle passes the device, and thus a timer to provide a delay between information collection and video capture may be provided.

In any of the embodiments, the communications link 22 is capable of transferring data at a transfer rate that substantially complies with the IEEE 1394-1995 Standard for a High Performance Serial Bus. (IEEE 1394). The IEEE 1394 standard provides for the transport of data at speeds substantially equal to 100, 200, or 400 megabits per second. In addition, because the interface is digital, there is no need to convert the digital data into analog data. Accordingly, the interface results in little or no loss of data integrity, thus substantially or completely eliminating the disadvantage of data loss associated with compression. The transfer may be performed via either asynchronous or isochronous transport. Using asynchronous transport, the data request is sent to a specific address, and an acknowledgement is returned. Using isochronous transport, data is transported at a predetermined rate, thus eliminating the need for buffering of the data. As used herein, the term IEEE 1394 and the phrase IEEE 1394-1995 Standard for a High Performance Serial Bus are intended to apply to the original standard, which was published in 1995, along with existing amendments and future amendments to the standard, such as the amendment known as IEEE 1394a-2000, so long as such standards provide for transfer of data at a rate substantially equal to 100, 200, and/or 400 megabits per second.

Referring again to FIG. 1, the video capture device 10 and/or the computing device 16 may include a transmitter such as 14 or 20 that may be used to transmit the captured video images and other data to another device. Such transmitters may be wireless transmitters, direct wired outputs, or any other device. In the alternative, instead of a transmitter, the video capture device 10 and/or the computer device 16 may include a portable memory unit such as a floppy disk, CD-R, ZIP drive, or other device onto which video images and other vehicle data may be downloaded and removed for viewing and/or analysis on another computing device.

FIG. 1 also illustrates and alternative embodiment of the present invention wherein a second video capture device 26 is positioned to receive digital visual images or a second vehicle 34 in the roadway. In accordance with this embodiment, the first video capture device 10 may be positioned to capture images of vehicles travelling in one lane of a roadway, while the second device may be positioned to capture images relating to vehicles travelling in another lane of the roadway. The second video capture device 26 also includes a communications port 28 that is in communication with the first video capture device 10 via a communications link 30. The communications link 28 and communications link 30 also substantially comply with the IEEE 1394 standard in that they are capable of transferring data at a transfer rate substantially equal to 100, 200, and/or 400 megabits per second. The cameras are connected in a series or "daisy cha in" format, which allows for data to be managed by a single or few cameras in accordance with the IEEE 1394 standard, and thus each video capture device need not contain all of the hardware required to manage the data.

In addition to the second video capture device 26 illustrated in FIG. 1, additional video capture devices may be connected in a series or "daisy chain" format, all of which are connected using the IEEE 1394 standard or another standard capable of transmission via transfer rates of 100, 200, and/or 400 megabits per second. Optionally and preferably, the cameras, information collectors, illumination sources, and other components are housed in one or more weatherproof boxes.

Optionally, the system may include an illumination source such as 11 or 27 to allow the image collector to obtain images at night. Preferably, the source is an infrared source, such as a source in the near-visual spectrum, to provide illumination without distracting drivers. Also optionally, a light sensor may be provided to automatically turn the illumination source on and off when required.

The IEEE 1394 standard, also known as FireWire, provides capability for the processor and memory to operate using one of numerous operating systems. Such operating systems may include MAC OS, Windows CE, Windows 2000 or 9x, Windows NT, Linux, or any other operating system. Preferably, a preferred embodiment of the present invention uses a Windows CE or Windows CE-compatible operating system.

Preferably, once an image of the vehicle is taken, the picture is analyzed, using a machine visioning or pattern recognition technology, to identify the vehicle feature or features that are desired. For example, if a license plate is the desired feature to be recognized, the analysis may identify the vehicle's license plate. The image of this desired feature may then be stored in a memory separate and apart from the entire image, thus saving memory space. Preferably, the desired portion of the image (such as a license plate) is stored and/or transmitted in an uncompressed format to preserve image quality, while the remainder of the image, if stored or transmitted at all, is done in a compressed format (such as a JPEG format). Optionally, however, the entire image or a portion of the image may be stored in a computer memory, either before or after transmission, either in compressed or uncompressed format.

Figure 2:
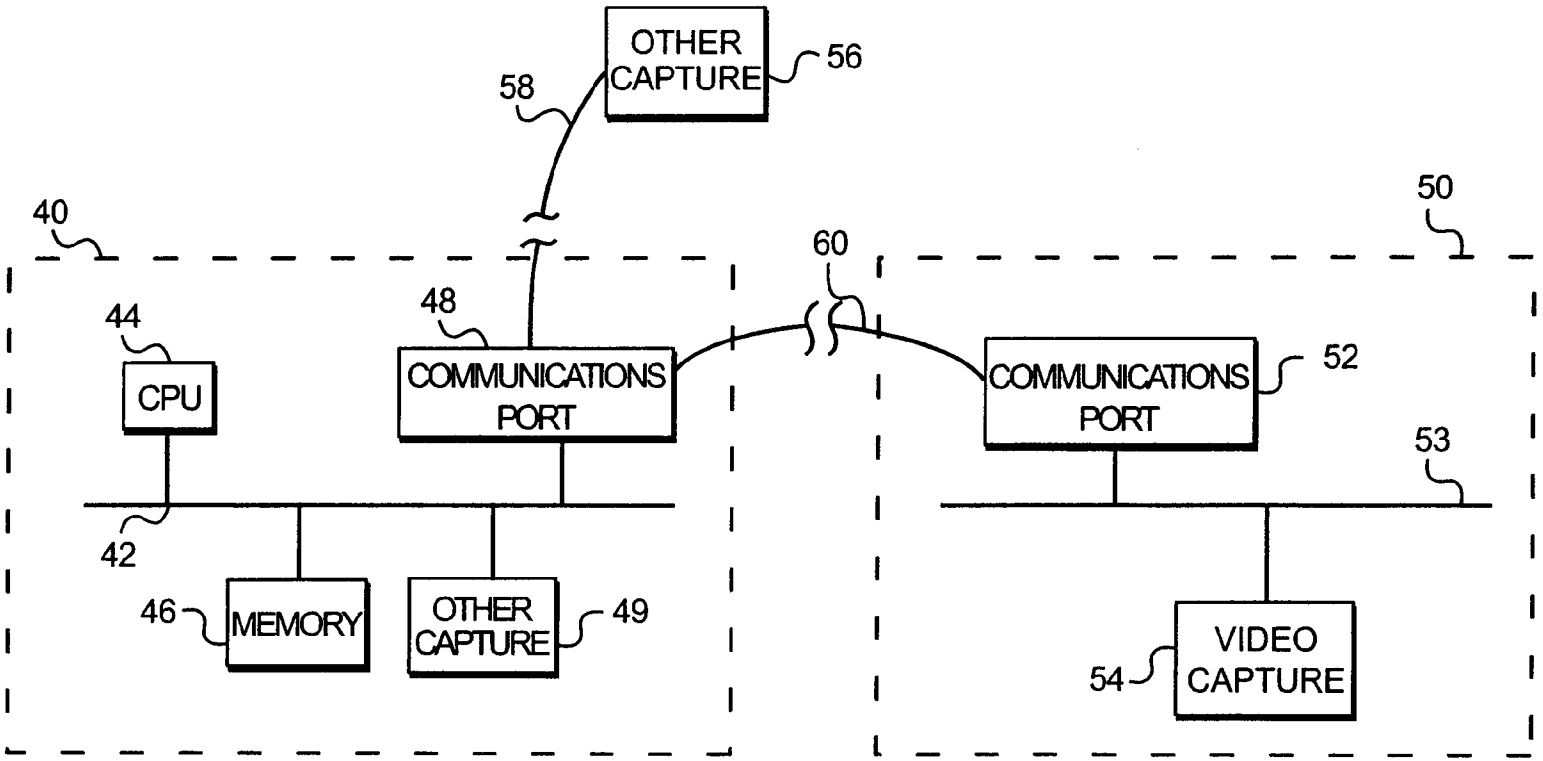
FIG. 2 is a block diagram that illustrates several hardware elements of a preferred embodiment of the present invention.

FIG. 2 illustrates exemplary internal hardware elements of many of the devices illustrated in FIG. 1. Referring to FIG. 2, a video capture device 50 includes a serial bus 53 that links a video capture unit 54, such as a digital camera, digital video camera, or other capture device, to a communications port 52. Additional elements, such as drivers and/or encoders, optionally may be placed between the video capture unit 54 and bus 53 and/or communications port 52 and bus 53. In addition, a computing device 40 contains a serial bus 42 that links internal computer features such as a processor 44, a memory 46, and a communications port 48. As with the video capture device, additional elements such as drivers and/or encoders may be included between the bus 42 and other elements of the computer 40.

The communications port 48 of the computer 40 and the communications port 52 of the video capture device 50 are linked via a communications link 60. The communications link 60 may be a direct wire or a wireless medium. The communications ports and communications link transfer data at rates substantially equal to 100, 200, and/or 400 megabits per second.

Another input device 49 may be included with the computer 40 to collect other information relating to the vehicle identified by the video capture device 50, such as emissions data, vehicle speed, and/or vehicle acceleration. The other capture device 49 may be included with the computer 40, or, in the alternative or in addition to having a capture device within the computer, an external capture device 56 may communicate with the computer 40 via the communications port 48 or a different communications port. It is preferable, but not necessary for the present invention, that the communications link 58 between the device used to capture emissions, speed, and/or acceleration data and the computer also comply with the IEEE 1394 standard.

Figure 3:
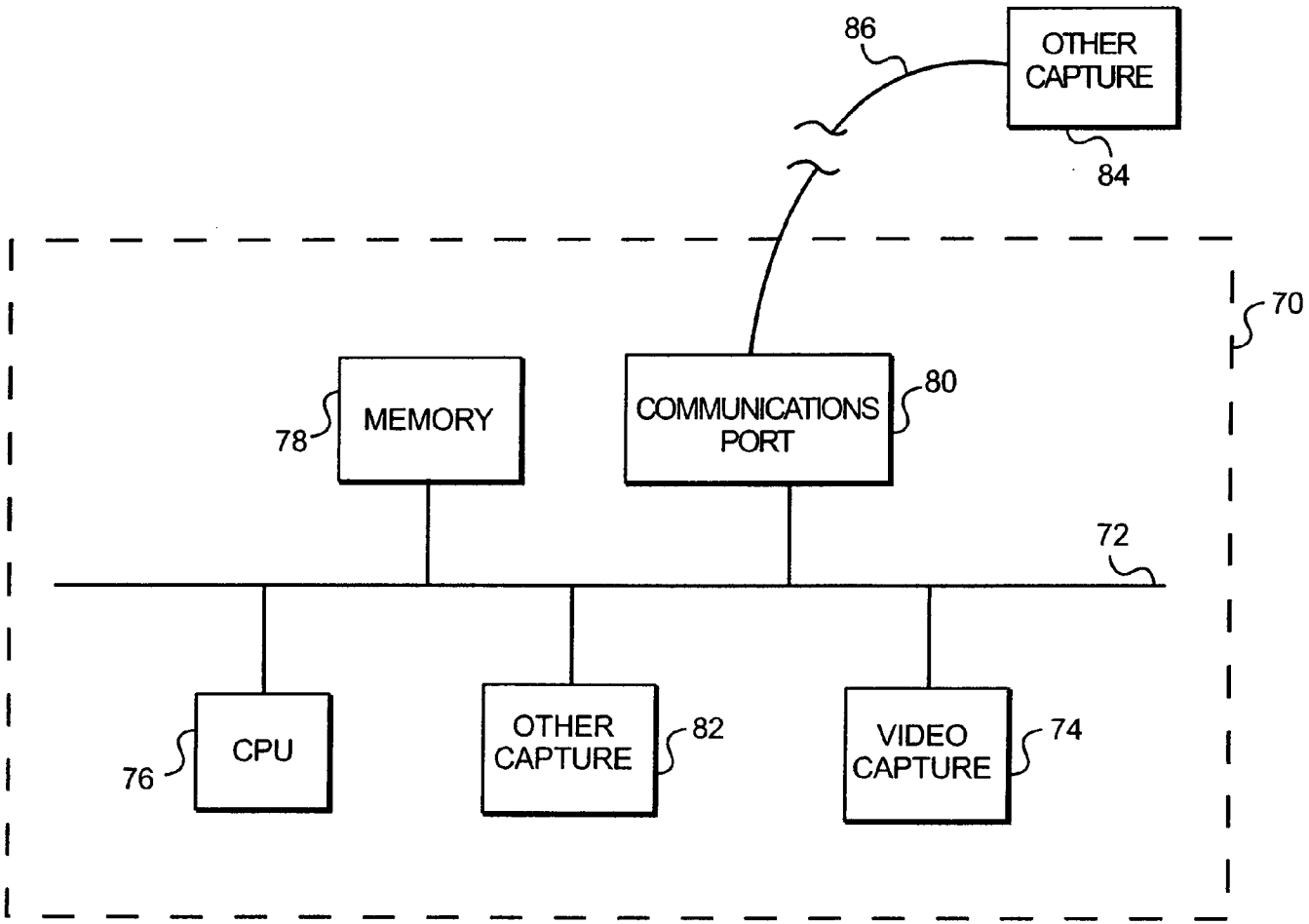
FIG. 3 is a block diagram that illustrates several hardware elements of an alternative embodiment of the present invention.

FIG. 3 illustrates an alternative embodiment of the present invention wherein the video capture device and computing elements are included within the same housing. Referring to FIG. 3 a housing 70 includes a video capture unit 74 such as a digital video camera or digital camcorder, a processing device 76 and a computer memory 78. All of these features are linked by a high speed serial bus 72 that substantially complies with the IEEE 1394 standard so that digital images collected by the video capture device 74 may be transferred to the memory 78 and/or the processor 76 at high rates of speed, preferably at rates substantially equal to 100, 200, and/or 400 megabits per second. The unit also contains a communications port 80 that may be used to transmit data to an external device. In the alternative, or in addition to the communications port 80, a device such as a floppy disk, recordable CD, ZIP drive or other device may be used to store and transport the data collected by the video capture device 74. Additional elements, such as drivers and/or encoders, may be included between the bus 72 and any of the other items described above.

Another capture element 82 may optionally be included within the housing 70 to capture other vehicle-related data, such as speed, acceleration, and/or emissions data. In addition to having another capture device within the housing 70 or in the alternative, an additional capture device 84 may be positioned external to the housing 70 and include a communications link 86 that may be used to transfer data captured by the other capture device 84 to the memory 78 or processor 76 via a communications port 80 and serial bus 72. As with the embodiment illustrated in FIG. 2, it is not necessary that the communications link 86 between the other capture device 84 and communications port 80 comply with the IEEE 1394 standard.

Figure 4:
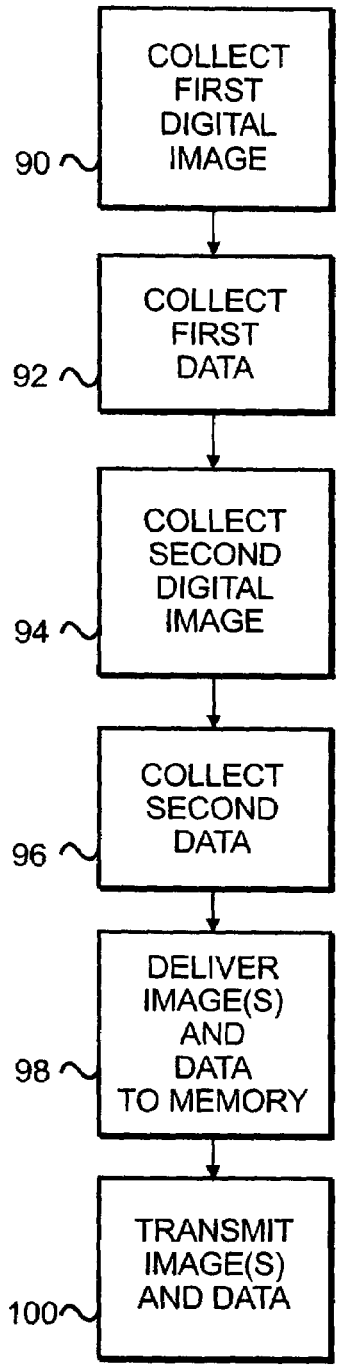
FIG. 4 is a flow chart illustrating the steps that a preferred embodiment of the present inventive system may follow to capture and manage visual images.

FIG. 4 is a block diagram that illustrates the steps that the method embodiment of the present invention may follow to capture video image and other data relating to a vehicle and manage such data. Referring to FIG. 4, a first digital image is collected (step 90) of a first vehicle. In addition, data relating to the same vehicle, such as the vehicle's speed, acceleration, and/or emissions are also collected by a sensing device such as an emissions sensor, speed sensor, laser, or other tracking device (step 92). Optionally, a second video capture device may collect a second digital image of a second vehicle (step 94). Second data relating to the second vehicle, such as speed, acceleration, and/or emissions data may also be collected (step 96) by the same information collection device, or a second information collection device may be trained to collect the data from the second vehicle. The images and data collected relating to each vehicle are preferably stored in a memory (step 98) and the delivery of the images will be performed via a communications link at a transfer rate substantially equal to 100, 200, and/or 400 megabits per second. Optionally, the images and/or data may be transmitted to an external location (step 100) and/or downloaded to a device such as a floppy disk, CD-recordable, and/or ZIP drive.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, all of which may fall within the scope of the invention.

What is claimed is:

1. A system for managing visual images of vehicles, comprising:

a first digital video image collector positioned to capture a first data file that is representative of a visual image of at least one non-emissions feature of a first vehicle moving on a roadway, the first digital video image collector including a first communications port;

a first video illumination source positioned to illuminate the at least one non-emissions feature of the first vehicle;

a computing device having a processor, a memory, and a second communications port;

a first communications link between the first communications port and the second communications port;

a first information collection device comprising an open path emission sensor in communication with the computer, the first information collection device having a first emissions illumination source to illuminate emissions of the first vehicle, and positioned to capture emissions data corresponding to the first vehicle.

2. The system of claim 1 wherein the first communications port is capable of transferring data at a transfer rate substantially equal to at least one of 100, 200, and 400 megabits per second.

3. The system of claim 1 wherein the first communications port substantially complies with the IEEE 1394 Standard for a High Performance Serial Bus.

4. The system of claim 1 wherein the first communications link comprises a serial connection capable of transferring data at a transfer rate substantially equal to a least one of 100, 200, and 400 megabits per second.

5. The system of claim 1 further comprising:

a second digital video image collector positioned to capture a second data file that is representative of a visual image of at least one non-emissions feature of a second vehicle moving on a roadway, the second digital camera including a third communications port;

a second video illumination source positioned to illuminate the at least one non-emissions feature of the second vehicle; and a second communications link between the third communications port and the first digital video image collector.

6. The system of claim 5 wherein the second information collection device is further positioned to capture emissions data corresponding to the second vehicle.

7. The system of claim 5 further comprising a second information collection device comprising an open path emissions sensor in communication with the computer, the second information collection device having a second emissions illumination source to illuminate emissions of the second vehicle, and positioned to capture emissions data corresponding to the second vehicle.

8. The system of claim 5 wherein the third communications port is capable of transferring data at a transfer rate substantially equal to at least one of 100, 200, and 400 megabits per second.

9. The system of claim 5 wherein the third communications port substantially complies with the IEEE 1394 Standard for a High Performance Serial Bus.

10. The system of claim 5 wherein the second communication link comprises a serial connection capable of transferring data at a transfer rate substantially equal to at least one of 100, 200and 400 megabits per second.

11. A method of capturing and managing vehicle images, comprising:

illuminating, using a first video illumination source, positioned to illuminate at least one non-emissions feature of the first vehicle;

collecting using a first video capture device, a first digital image of at least one non-emissions feature of a first vehicle recognizing a desired feature in the digital image;

storing the desired feature in an uncompressed format;

storing the remainder of the image in a compressed format;

collecting, using a data collection device comprising an open path emission sensor having a first emissions illumination source to illuminate the emissions of the first vehicle, and first data representative of emissions of the first vehicle; and delivering the first digital image and the first data to a computer program memory via at least one communications link.

12. The method of claim 11 wherein the delivering step is performed at a transfer rate substantially equal to at least one of 100, 200, and 400 megabits per second.

13. The method of claim 11 wherein the delivering step is performed via a serial connection that substantially complies with the IEEE 1394 Standard for a High Performance Serial Bus.

14. The method of claim 11 comprising wherein the first video capture device and the memory are housed in a single housing, and the delivering step is performed via an IEEE 1394 serial bus.

15. The method of claim 14 wherein:

the first video capture device and the memory are housed in separate housing, and the communication link comprises a first communications port associated with the video capture device, a second communications port associated with the memory, and a serial cable; and the delivering step comprises transferring data at a transfer rate substantially equal at least one of 100, 200, and 400 megabits per second.

16. The method of claim 11 comprising the additional steps of:

illuminating, using a second video illumination source, positioned to illuminate at least one non-emissions feature of the second vehicle;

collecting, using a second video capture device, a second digital image of at least one non-emissions feature of a second vehicle;

collecting, using a data collection device, having a second emissions illumination source to illuminate emissions of the second vehicle, second data representative of emissions of the second vehicle recognizing a desired feature in the digital image;

storing the desired feature in an uncompressed format;

storing the remainder of the image in a compressed format; and delivering the second digital image and the second data to the computer program memory.

17. The method of claim 16 wherein the delivering of the second data in the delivering step comprises delivering the second digital image to the first video capture device via a second communications link and subsequently delivering the second digital image to the computer program memory via a first communications link.

18. A system for capturing and managing vehicle images, comprising:

a means for capturing a first image of a first vehicle;

means for illuminating for video at least one non-emissions feature of the first vehicle, said means positioned to illuminate the non-emissions feature of the first vehicle;

a means for capturing first data representative corresponding to the first vehicle comprising an open path emission sensor, having means for emissions-illuminating to illuminate the emissions of the first vehicle and having means for recognizing a desired feature in the digital image, storing the desired feature in an uncompressed format, and storing the remainder of the image in a compressed format; and a means for delivering the first image and the first data to a memory of a computing device at a transfer rate substantially equal to at least one of 100, 200, and 400 megabits per second.

19. The system of claim 18, further comprising:

means for illuminating for video at least one non-emissions feature of the second vehicle, said means positioned to illuminate the non-emissions feature of the second vehicle;

a means for capturing a second image of a second vehicle;

a means for capturing second data representative of emissions corresponding to the second vehicle, having means for emissions-illuminating to illuminate the emissions of the second vehicle and having means for recognizing a desired feature in the digital image, storing the desired feature in an uncompressed format, and storing the remainder of the image in a compressed format; and a means for delivering the second image and the second data to the memory at a transfer rate substantially equal to at least one of 100, 200, and 400 megabits per second.

* * * * *

UNITED STATES PATENT AND TRADEMARK OFFICE

CERTIFICATE OF CORRECTION

PATENT NO. : 7,183,945 B2
APPLICATION NO. : 09/932499
DATED : February 27, 2007
INVENTOR(S) : John DiDomenico et al.

It is certified that error appears in the above-identified patent and that said Letters Patent is hereby corrected as shown below:

Column 8
Line 11, please replace "200and" with --200, and--.

Signed and Sealed this

First Day of May, 2007

JON W. DUDAS
*Director of the United States Patent and Trademark Office*